US005826707A

United States Patent [19]

Williams

[11] Patent Number: 5,826,707

[45] Date of Patent: Oct. 27, 1998

[54] PROTECTIVE HOUSING FOR WATER PRESSURE SWITCH

[75] Inventor: Warren E. Williams, Bradenton, Fla.

[73] Assignee: W. E. Williams Enterprises, Inc., Bradenton, Fla.

[21] Appl. No.: 814,985

[22] Filed: Mar. 14, 1997

Related U.S. Application Data

[60] Provisional application No. 60/013,508 Mar. 15, 1996.

[51] Int. Cl.[6] ..... H01H 9/04

[52] U.S. Cl. ..... 200/302.1; 200/293; 220/3.2; 220/3.8

[58] Field of Search ..... 200/302.1, 303, 200/293, 304; 206/701; 220/3.2, 3.8

[56] References Cited

U.S. PATENT DOCUMENTS

| | | | |
|---|---|---|---|
| 2,631,250 | 3/1953 | Parker | 200/302.1 |
| 2,632,083 | 3/1953 | Shaffer | 200/302.1 |
| 3,105,233 | 9/1963 | D'Amore et al. | 200/302.1 |
| 4,158,757 | 6/1979 | Reichert et al. | 200/302.1 |

*Primary Examiner*—David J. Walczak
*Attorney, Agent, or Firm*—Gifford, Krass, Groh, Sprinkle, Patmore Anderson & Citkowski, P.C.

[57] ABSTRACT

A protective housing for control switches such as pressure regulating switches for water pumps has been provided in which a cylindrical metal body member is closed by metal end plates in tightly fitted relationship to the body member to contain a switch. The switch also has a water connection passing through one of the plates which is formed by tight metal to metal contact, all for the purpose of obstructing access to the switch by insects such as fire ants.

5 Claims, 3 Drawing Sheets

PROTECTIVE HOUSING FOR WATER PRESSURE SWITCH

This application claims the benefit of U.S. Provisional Application No. 60/013,508 filed Mar. 15, 1996.

This invention relates to water pressure activated electrical switches and more particularly to protective housing for protecting such switches from insects.

BACKGROUND OF THE INVENTION

Insects, and particularly fire ants, attack electric control switches used in the operation of water pumps to maintain the water pressure in some selected pressure range, for example, ten to thirty psi. The insects and ants appear to be attracted by any electrical field that may be formed and attack such parts as gaskets or seals to gain entry to the usual housings of the switches. The resultant debris together with the large volume of ants or other insects causes fouling of the electrical contacts and prevents proper operation of the switches which results not only in their failure but in failure of the associated water pumps.

The maintenance of such switches and pumps becomes very expensive in hot, wet areas where fire ants and other insects thrive.

It is an object of the invention to provide a housing for pressure regulating switches which prevents access to the switches by fire ants or other insects.

It also is an object of the invention to provide such a housing for switches which may accept a variety of different switches and which can be used with switches already installed.

The objects of the invention are obtained by a preferred embodiment of the invention shown in the drawings in which:

The objects of the invention are attained by a preferred embodiment including a cylindrical metallic body member having the ends closed by closely fitting end caps or cover plates. The switch to be protected is mounted on one of the plates with its water connection in closely fitted relation to the plate. The other of the plates is removable to give access to the switch control lever. The tightly fitting surfaces act as a barrier to the entry of ants to the switch.

DETAILED DESCRIPTION OF A PREFERRED EMBODIMENT

Figure 1:
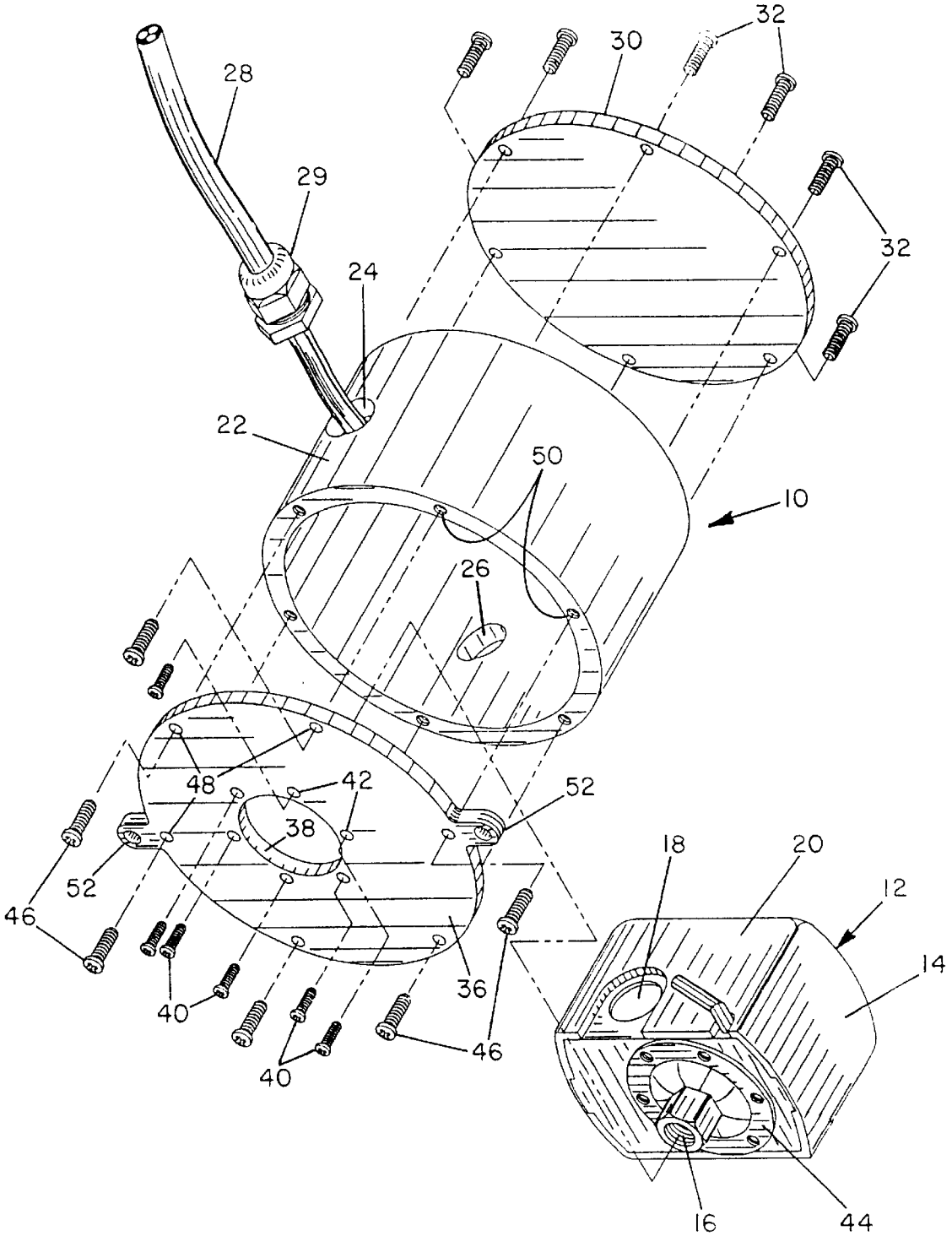
FIG. 1 is an exploded view in perspective of the housing and an associated water pressure switch.
Figure 2:
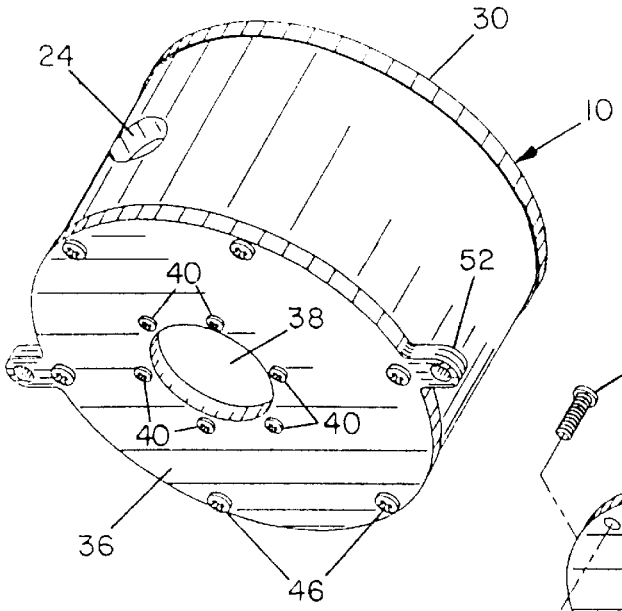
FIG. 2 is a housing alone in its closed position.
Figure 3:
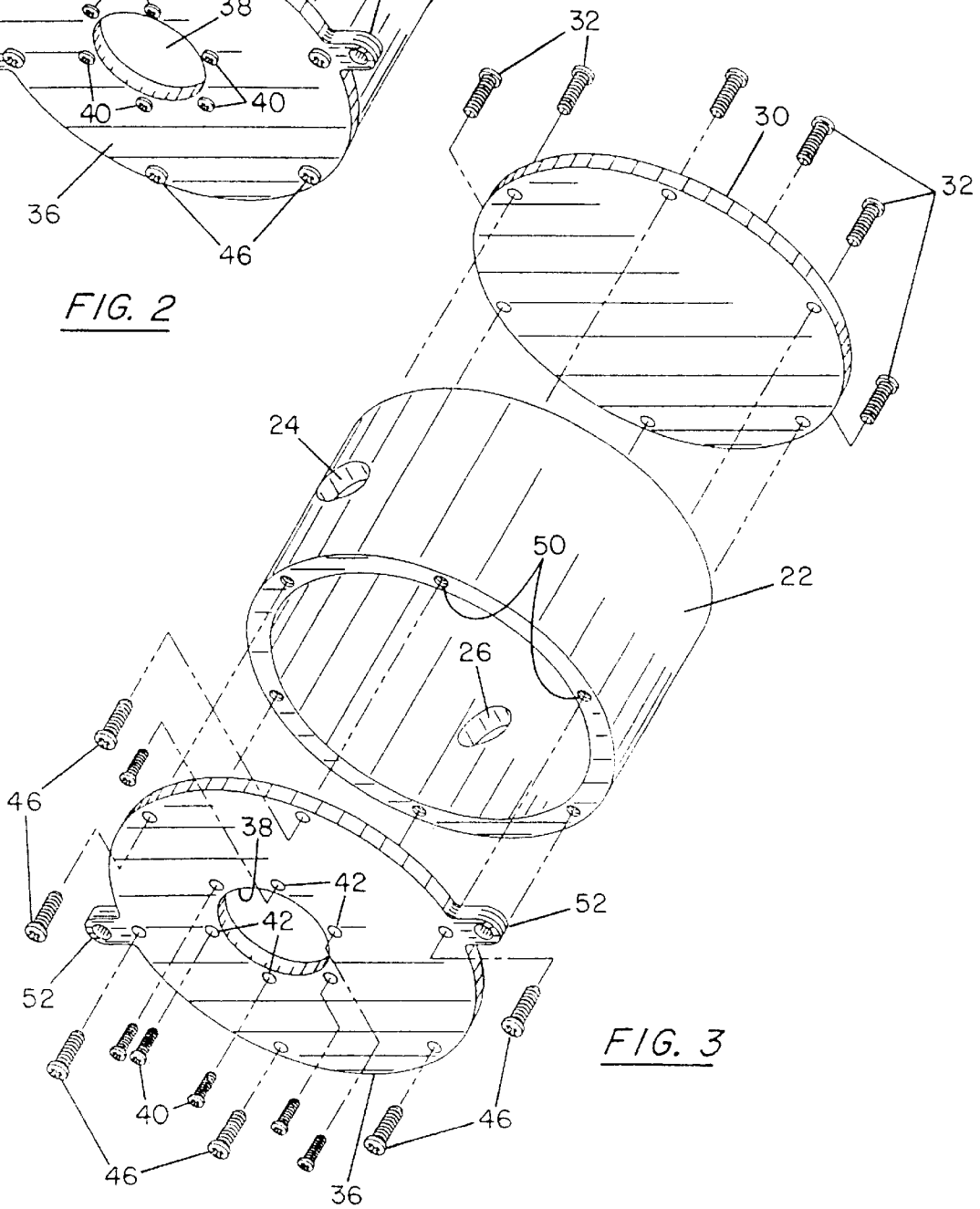
FIG. 3 is an exploded perspective view of the housing alone.

Referring to the drawings, a preferred embodiment of the invention incorporates a housing designated at 10 for enclosing a water pressure switch 12.

As seen in FIG. 1, the switch 12 has a conventional housing 14 with a water inlet fitting 16 and an opening 18 to receive an electrical conduit. One such switch which has been found suitable is available from Square D Company and is identified as Form M4, Series B, which operates to energize a pump when water pressure drops to 30 psi and to stop the pump when water pressure reaches 50 psi. The switch 12 has a manually operated lever 20 for manual movement of the switch from automatic to starting and off positions.

The housing 10 has a body 22 having a tubular cross-section which preferably is made of high quality aircraft aluminum and of a size sufficient to receive pressure regulating switches of the type indicated at 12.

Figure 4:
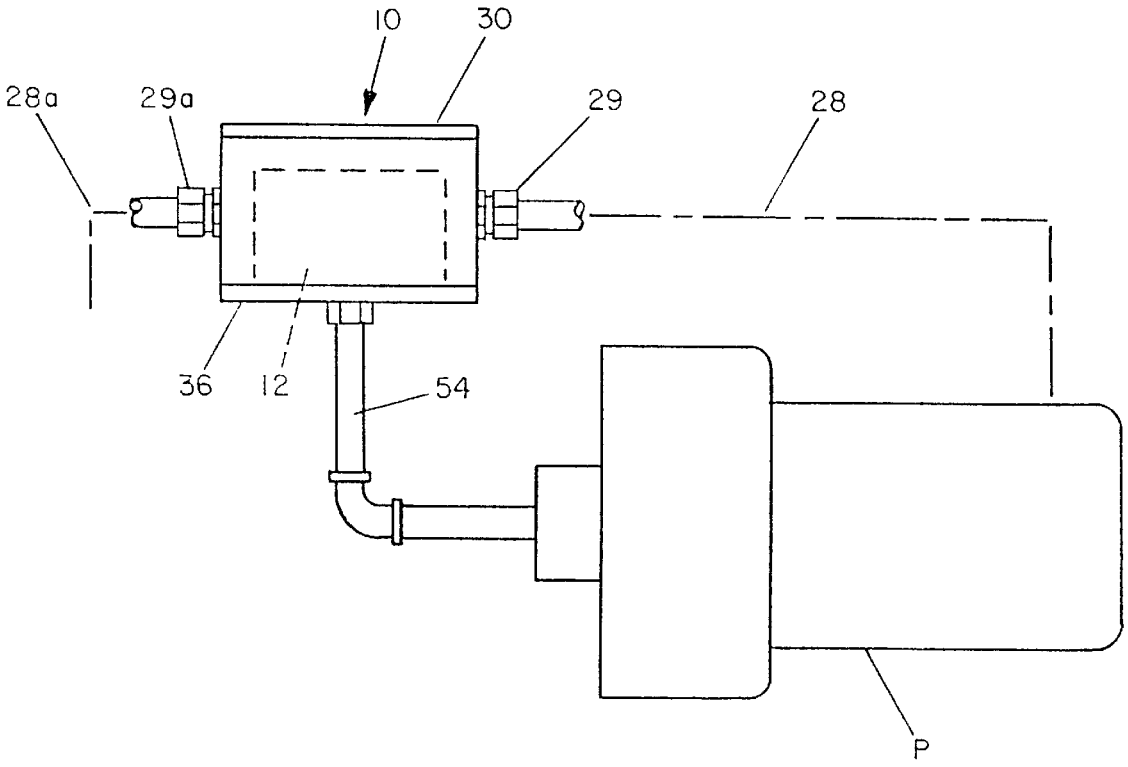
FIG. 4 is a diagrammatic view of the protective housing shown in relation to a water pump.

Opposed portions of the tubular member 22 are provided with electrical access openings 24 and 26. By way of example, an electrical conduit 28 may be positioned relative to the electrical opening 24 by means of a water tight commercially available connector 29 which holds the conduit 28 securely in position relative to the tubular housing member 22. Such connectors are available commercially under the name HEYCO and are particularly adapted to accept round electrical conduits made up of multiple conductors and to form a tight connection between the conduit 28 and the body 22. Such a conduit 28 may extend between the pressure regulating switch 12 and a electrically driven water pump as seen in FIG. 4. Similarly, the electrical conduit opening 26 can receive another electrical conduit 28*a* extending to a source of electrical power and can be held in position by a similar water tight, commercially available connector 29*a*.

One end of the tubular housing 22 is closed by a flat, disc-shaped wall 30 held in position by fastening means in the form of a plurality of screws 32 threaded into the housing 22. The other end of the tubular housing 22 is closed by a flat, disc-shaped wall 36 which also acts to support the pressure regulating switch 12. The wall 36 is provided with a central opening 38 which receives the water inlet 16 of the switch 12. The switch 12 is held in position on the flat wall 36 by a plurality of screws 40 passing through openings 42 in the wall 36 and threaded into the annular wall portion 44 (FIG. 1) surrounding the water inlet 16. The wall 36 together with the mounted pressure switch 12 is held in position relative to the end of the tubular housing 22 by fastening means in the form of a plurality of screws 46 passing through openings 48 in the wall 36 and received by threaded openings in the annular end wall of the tubular housing 22 to maintain the wall 36 and housing in tight engagement with each other.

The fit between the ends of the tubular housing 22 and the faces of the wall 30 and wall 36 is formed very accurately so that when tightly fastened together the flat surfaces are complimentary to each other with the tolerances being between one and ten thousandths of an inch. This has been found satisfactory for excluding fire ants and at the same time allow for pressure equalization. Similarly the finish on the face of the wall 36 and the abutting annular wall 44 on the pressure switch 12 are flat and complimentary to each other and kept at a very close tolerance of between one and ten thousandths of an inch.

The protective housing 10 and switch 12 can be supported directly on the pump P by attaching the water inlet 16 of the switch 12 to a water pipe 54. The water pipe 54 acts not only as a supply of water to the switch but also as a rigid support for the entire housing 10 and switch assembly 12 relative to the pump P.

The wall 36 supporting the switch 12 also is provided with diametrically opposed ears 52. If desired, the ears 52 can be used to mount the housing assembly and switch to structures such as walls, or posts separated from the pump but sufficiently close to regulate the pump P.

The interior of the housing 10 is protected from entrance of fire ants by the very close fit between the walls 30 and 36 at the opposite ends of the tubular housing 22 and by the water tight connectors 29 for the electrical conduits 28. Also, the very close fit between the annular surrounding opening 38 and the annular wall surface 44 on the switch 14 prevents the entry of fire ants. The close tolerances although preventing the admission of insects and fire ants permits equalization of air pressure within the housing and exterior of the housing.

It will be seen that the housing affords ample access to the pressure regulating switch 12 so that the switch lever 20 can be actuated by removal of the end wall 30. Also, the housing 10 can be easily installed relative to already installed switches 12 by disconnecting the existing water and electrical connections to the switch 20 and repositioning them in a manner described above. More specifically, the installation typically can involve mounting the end plate 36 on the switch 14 by way of screws 40 and making the water connection to pipe 54. Thereafter the body 22 can be assembled to the plate 36 and the electrical conduits 28 and 28*a* can be positioned by means of connectors 29 and 29*a*.

After the pump is started by moving lever 20 to a "start" position, the housing can be closed to the entrance of ants or other insects by placing the cover plate 30 in position by tightening screws 32.

A protective housing for electrical control switches used to protect the switches from attack by insects such as fire ants. The housing includes a cylindrical body member having opposite ends covered by flat metal plates in a tight fitting relationship to the ends of the cylindrical housing. The switch also is mounted on one of the end plates to which a water connection to the switch is made by tight metal to metal contact which obstructs the entry of fire ants. Electrical connections are made by proven connectors holding the electrical conduits relative to the housing and acting as a barrier to insects.

I claim:

1. A protective housing for a pump control switch comprising:

a cylindrical, metallic body member having opposed open ends forming flat annular surfaces, a first metallic cover plate having an outer edge and a flat annular sealing surface adjacent said edge of said first cover plate complementary to one of said flat annular surfaces, a second metallic cover plate having a an outer edge and a flat annular sealing surface adjacent said edge of said second cover plate complementary to the other of said flat annular surfaces, fastening means detachably connecting said cover plates in tight relation to said body member, a switch adapted to have a connection to a conduit communicating with a source of water, said conduit passing through an opening formed in said second cover plate, an annular metallic surface on said switch surrounding said connection to said conduit and being complementary to a flat annular surface on said second cover plate surrounding said opening in said second cover plate, and additional fastening means for holding said surfaces on said switch and surrounding said opening in tightly fitting relation with each other to position said switch within said body member.

2. The combination of claim 1 wherein said complementary flat annular surfaces engage with each other with a gap of no more than one ten thousands of an inch.

3. The combination of claim 1 wherein said first cover plate opposite to said second cover plate is removable to give access to said switch within said housing.

4. The combination of claim 1 and further comprising electrical conductors passing through the body member for attachment to said switch and coupling members surrounding said conductors and engaging said body member to present an insect barrier.

5. The combination of claim 1 wherein said fastening means are a plurality of uniformly spaced screw fasteners.

* * * * *